US011225784B2

(12) United States Patent
Yang

(10) Patent No.: US 11,225,784 B2
(45) Date of Patent: Jan. 18, 2022

(54) SELF-CLEANING TOILET

(71) Applicant: Feng-An Yang, Hsinchu (TW)

(72) Inventor: Feng-An Yang, Hsinchu (TW)

( * ) Notice: Subject to any disclaimer, the term of this patent is extended or adjusted under 35 U.S.C. 154(b) by 0 days.

(21) Appl. No.: 17/067,724

(22) Filed: Oct. 11, 2020

(65) Prior Publication Data

US 2021/0198882 A1 Jul. 1, 2021

(30) Foreign Application Priority Data

Dec. 31, 2019 (TW) ..... 108148669

(51) Int. Cl.

| | |
|---|---|
| ***E03D 9/00*** | (2006.01) |
| ***E03D 9/03*** | (2006.01) |
| ***E03D 5/10*** | (2006.01) |
| *E03D 5/02* | (2006.01) |
| *E03D 1/34* | (2006.01) |

(52) U.S. Cl.

CPC ..... *E03D 9/002* (2013.01); *E03D 5/10* (2013.01); *E03D 9/032* (2013.01); *E03D 9/038* (2013.01); *E03D 1/34* (2013.01); *E03D 5/026* (2013.01)

(58) Field of Classification Search

CPC ..... E03D 9/002; E03D 9/032; E03D 9/038; E03D 5/10; E03D 5/026

USPC ..... 4/227.1

See application file for complete search history.

(56) References Cited

U.S. PATENT DOCUMENTS

| | | | | |
|---|---|---|---|---|
| 4,729,133 | A * | 3/1988 | Wileman, III | E03D 9/002 4/233 |
| 4,875,243 | A * | 10/1989 | Wileman, III | A47K 13/302 4/662 |
| 2010/0146693 | A1* | 6/2010 | Yamaguchi | E03D 11/08 4/420 |
| 2017/0030065 | A1* | 2/2017 | Bucher | E03D 5/092 |
| 2017/0058500 | A1* | 3/2017 | Garrels | C11D 11/0052 |

* cited by examiner

*Primary Examiner* — Huyen D Le

(57) ABSTRACT

A self-cleaning toilet has: a toilet, a cleaning device, a solenoid valve and a blocking member. The toilet has a sitting toilet seat and a water tank. The sitting toilet seat is formed with a urinal, and one end of the urinal has an enlarged opening to form a seat, and the urinal tapers from the seat to the other end to form a drain elbow. The water tank is connected to the toilet with an outlet pipe, and the water tank is connected with an input pipe, a cleaning device is set in the toilet with a controller, and the controller is connected with a plurality of the ultrasonic transducers and a full water level sensor, The ultrasonic transducers are fixed on the inner wall of the urinal. The solenoid valve is connected to the input pipe, and a blocking member is connected to the drain elbow.

10 Claims, 9 Drawing Sheets

SELF-CLEANING TOILET

BACKGROUND OF INVENTION

Field of Invention

The present invention relates to a toilet, and more particularly to a self-cleaning toilet.

Description of Related Art

Toilets are necessary household device that is frequently used by everyone in daily life, after a number of uses for long periods, the toilet collects dirt on the inner wall of the toilet and turns yellow, which causes bad smell and bacteria breeding. The common practice requires scrubbing, which is difficult to maintain regularly. Moreover, because the toilets have urinals with seats for seating, but the lower edge of the seat is concave, which makes it difficult for the brush to reach the concave position.

Therefore, it is desirable to provide a self-cleaning toilet to mitigate and/or obviate the aforementioned problems.

SUMMARY OF INVENTION

An objective of present invention is to provide a self-cleaning toilet, which is capable of improving the above-mention problems.

In order to achieve the above mentioned objective, a self-cleaning toilet has: a toilet, a cleaning device, a solenoid valve and a blocking member. The toilet has a sitting toilet seat and a water tank. The sitting toilet seat is formed with a urinal, and one end of the urinal has an enlarged opening to form a seat, and the urinal tapers from the seat to the other end to form a drain elbow. The water tank is connected to the toilet with an outlet pipe, and the water tank is connected with an input pipe, a cleaning device is set in the toilet with a controller, and the controller is connected with a plurality of the ultrasonic transducers and a full water level sensor, The ultrasonic transducers are fixed on the inner wall of the urinal. The solenoid valve is connected to the input pipe, and a blocking member is connected to the drain elbow.

Other objects, advantages, and novel features of invention will become more apparent from the following detailed description when taken in conjunction with the accompanying drawings.

DETAILED DESCRIPTION OF PREFERRED EMBODIMENT

Figure 1:
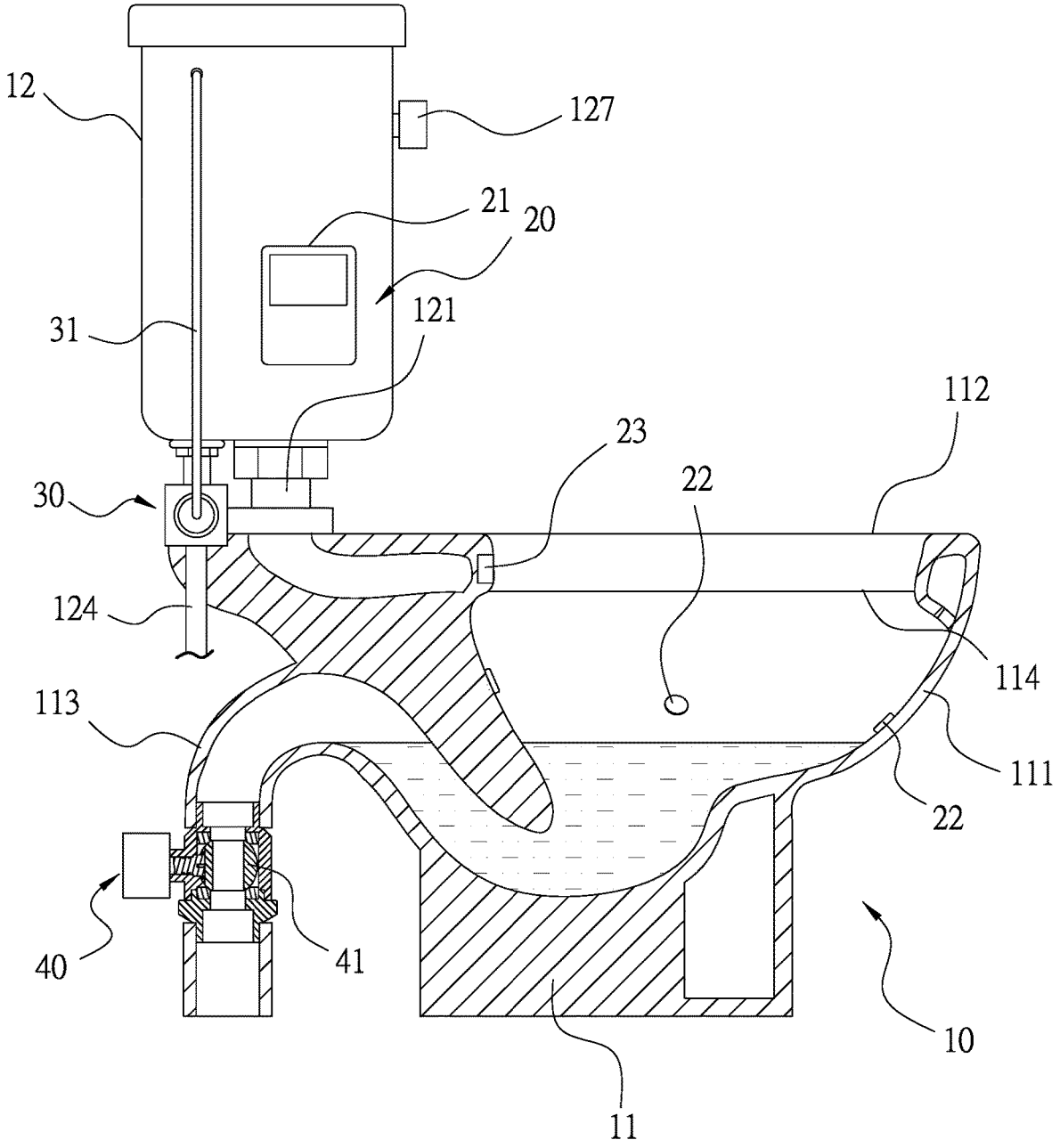
FIG. 1 is a partial cross-sectional view of a preferred embodiment according to the present invention.
Figure 2:
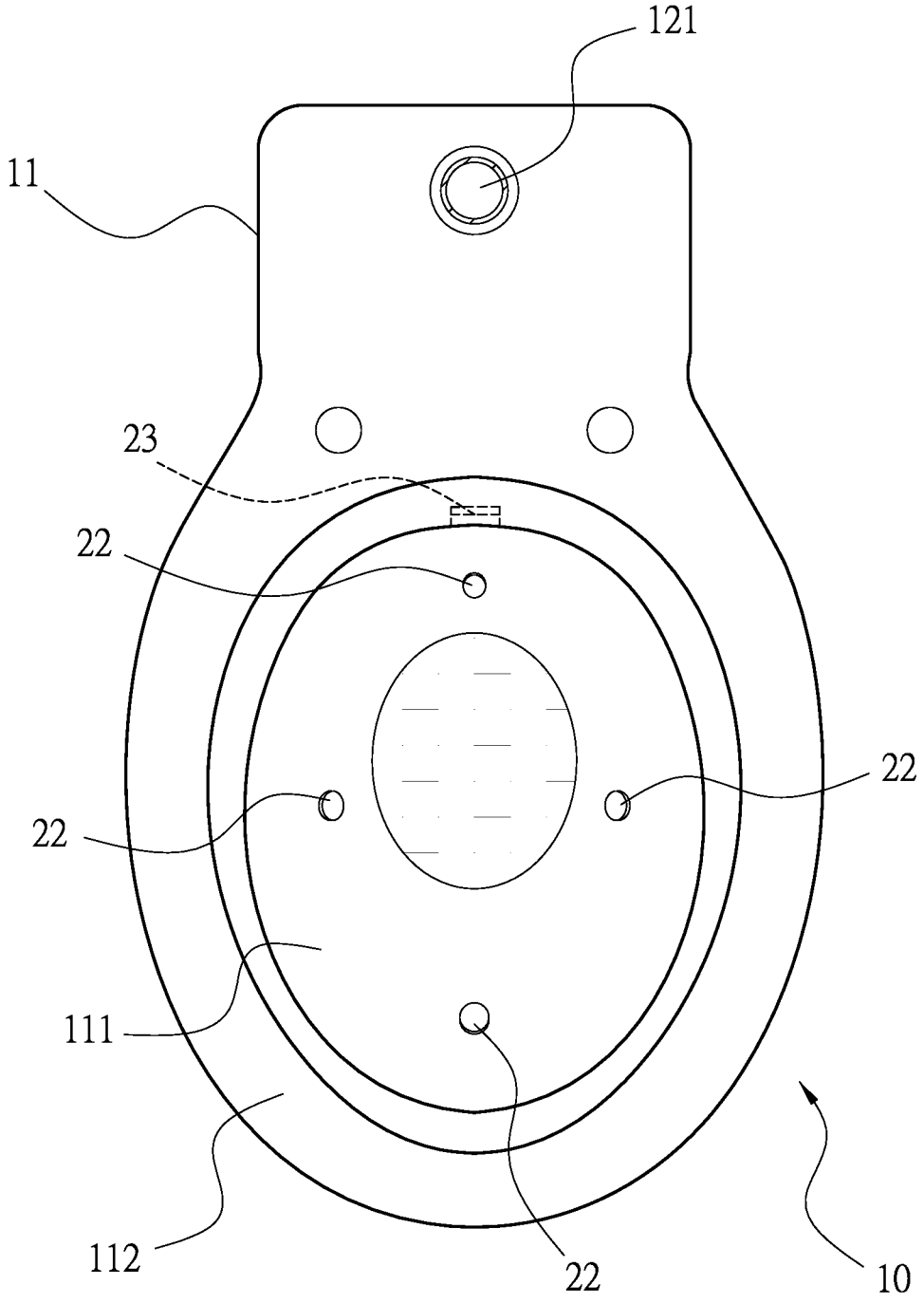
FIG. 2 is a schematic top view of the preferred embodiment according to the present invention.
Figure 3:
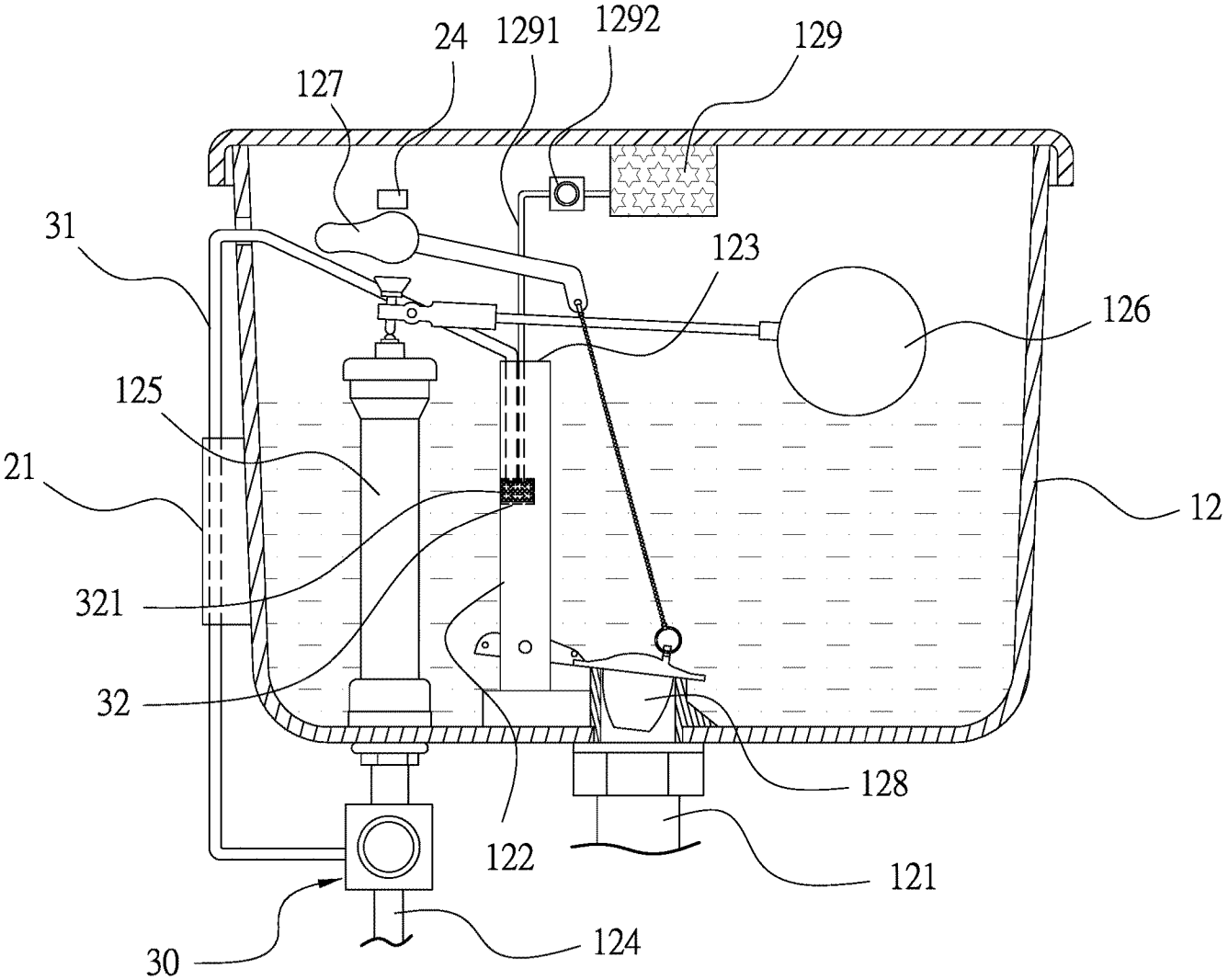
FIG. 3 is a sectional view of the water tank of the preferred embodiment according to the present invention.

Please refer to FIG. 1, FIG. 2 and FIG. 3. A self-cleaning toilet comprises: a toilet 10, a cleaning device 20, a solenoid valve 30 and a blocking member 40. The toilet 10 has a sitting toilet seat 11 and a water tank 12. The sitting toilet seat 11 is formed with a urinal 111, and one end of the urinal 111 has an enlarged opening to form a seat 112, and the urinal 111 tapers from the seat 112 to the other end to form a drain elbow 113. An inner edge of the urinal 111 adjacent to the seat comprising a flushing ring opening 114. The water tank 12 is mounted above the sitting toilet seat 11 and has an outlet pipe 121 connected to the flushing ring opening 114 of the toilet 10. The outlet pipe 121 of the water tank 12 is bypassed by an overflow pipe 122, and the overflow pipe 122 has an overflow opening 123 at a position that is higher than a full water level of the water tank 12. The water tank 12 is connected to an input pipe 124, and an input pipe 124 further comprises a water injection rod 125 inserted into the water tank 12, a floating ball 126 connected to a top end of the water injection rod 125. The water injection rod 125 further comprises a control handle 127 connected to a water plug 128 for controlling the outlet pipe 121. A cleaning device 20 comprises a controller 21 and disposed in the toilet 10, and the controller 21 is connected to a plurality of ultrasonic transducers 22 and at least one full water level sensor 23. The ultrasonic transducers 22 are mounted on an inner wall of the toilet 10 higher than a low water level of the urinal 111, and the full water level 23 are mounted under the seat 112. A solenoid valve 30 is connected to the input pipe 124 and a bypass pipe 31, the bypass pipe 31 penetrates into the water tank 12 and is disposed at the overflow opening 123 into the overflow pipe 122, and the solenoid valve 30 is electrically connected to the controller 21. Therefore, water flows into the overflow pipe 122, the outlet pipe 121 and the flushing ring opening 114 then enters into the urinal 111. A blocking member 40 is connected to the drain elbow 113 and electrically connected to the controller 21, and the blocking member 40 controls flow in the drain elbow 113. When the blocking member 40 blocks the drain elbow 113, the solenoid valve 30 is configured to control water flow to flow into the urinal 111 from the bypass pipe 31, and after the full water level sensor 23 detects a full water level, the water is stopped and the ultrasonic transducers 22 perform clean.

For actual use, as shown in FIGS. 4, 5, 6, and 7, the controller 21 of the cleaning device 20 can be assembled at any position of the toilet 10, such as on the top or the side of the water tank 12, which allows users to conveniently view the panel information and set the corresponding position. The controller 21 is electrically connected to the ultrasonic transducers 22, the full water level sensor 23, the blocking member 40 and the solenoid valve 30 at the same time, and the ultrasonic transducers 22 and the full water level sensor 23 are both installed in the urinal 111, the blocking member 40 is connected to the drain elbow 113 of the toilet 10, and the solenoid valve 30 is connected to the input pipe 124 of the water tank 12. The controller 21 is used to automatically clean the toilet 10, and the automatic cleaning steps are as follows: Step A: the controller 21 drives the blocking member 40 according to the pre-set time, so that the blocking member 40 blocks the drain elbow 113 of the toilet 10. Step B: the controller 21 activates the solenoid valve 30 to drain the water in the input pipe 124, to let the water flow through the bypass pipe 31 and directly inject water into the urinal 111 of the toilet 10. Since the bypass pipe 31 penetrates into the water tank 12 and is insert into the overflow opening 123 of the overflow pipe 122; since the overflow pipe 122 is connected to the outlet pipe 121, the original structure can be slightly modified so the outlet pipe 121 directly fills the flushing ring opening 114 of the sitting toilet seat 11 is filled with water, and the water level in the urinal 111 rises because of the blocking member 40. Step C: when the full water level sensor 23 detects that the water in the urinal 111 reaches the full water level, the detection signal is sent to the controller 21, the solenoid valve 30 is closed by the controller 21 to stop further water injection; the full water level is the flushing ring opening 114 position of the sitting toilet seat 11 covered by the water surface, so that the flushing ring opening 114 position can be cleaned. Step D: the controller 21 activates the ultrasonic transducers 22 for oscillating cleaning, so that the dirt attached to the inner wall of the urinal 111 can be cleaned and separated. The oscillation time of the ultrasonic transducers 22 is set by the user, and the position and quantity of the ultrasonic transducers 22 are depended on the style of the toilet 10. Step E: the ultrasonic transducers 22 are turned off and blocking member 40 is turn on, and the sewage after cleaning is drained from the drain elbow 113. Furthermore, the inner wall of the urinal 111 is flushed at a high speed due to the full water level and the water pressure, thereby preventing the dirt from re-attaching, and also has washing off the obstruction practical to achieve the effect of timing and automatic cleaning of the urinal 111. In the preferred embodiment, the controller 21 is electrically connected to a sensing element 24 mounted at the control handle 127, the control handle 127 controls the blocking member 40 to allow the urinal 111 to drain, which finishes the cleaning process.

Figure 4:
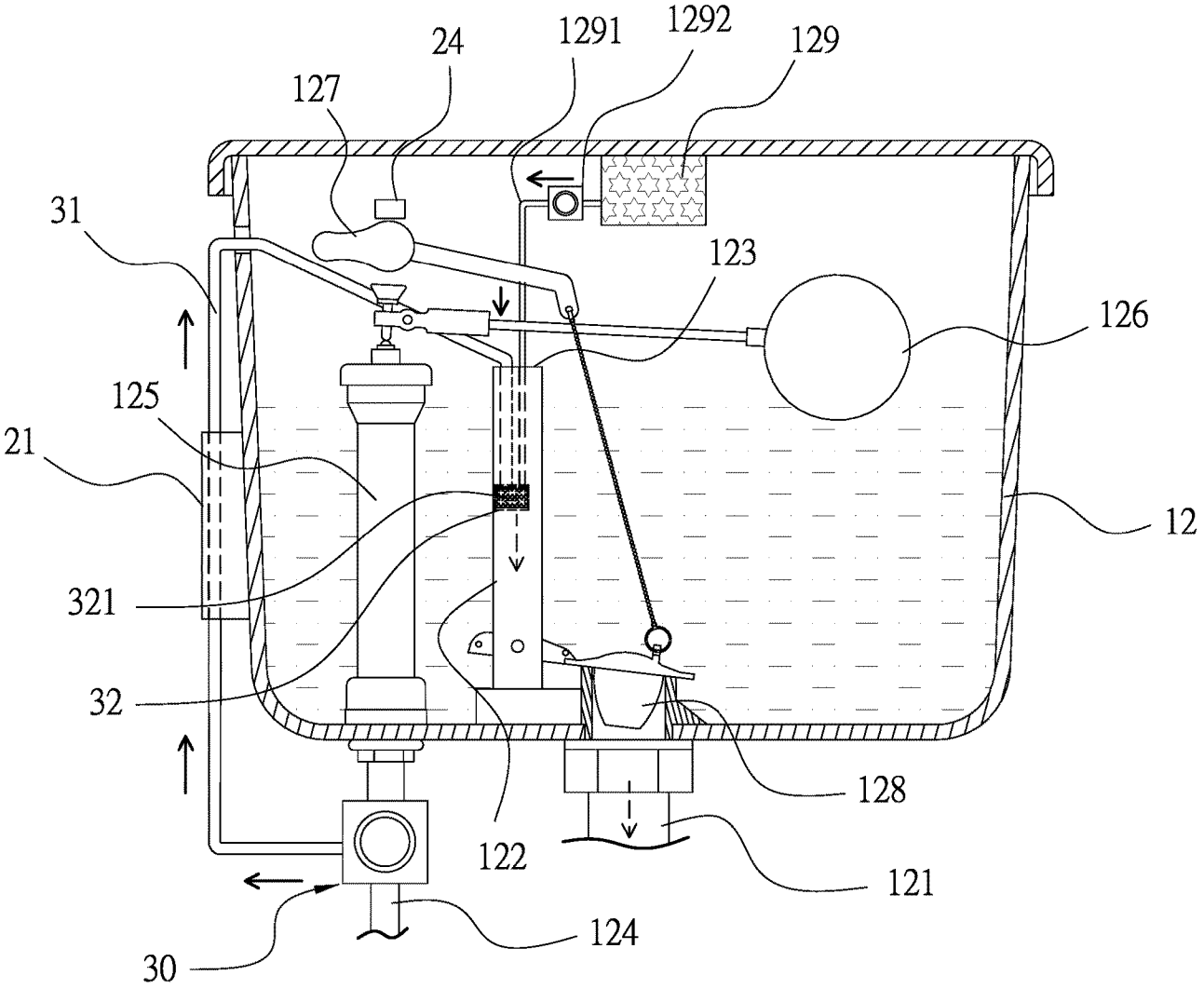
FIG. 4 is a schematic drawing of the operation of the water tank of the preferred embodiment according to the present invention.
Figure 5:
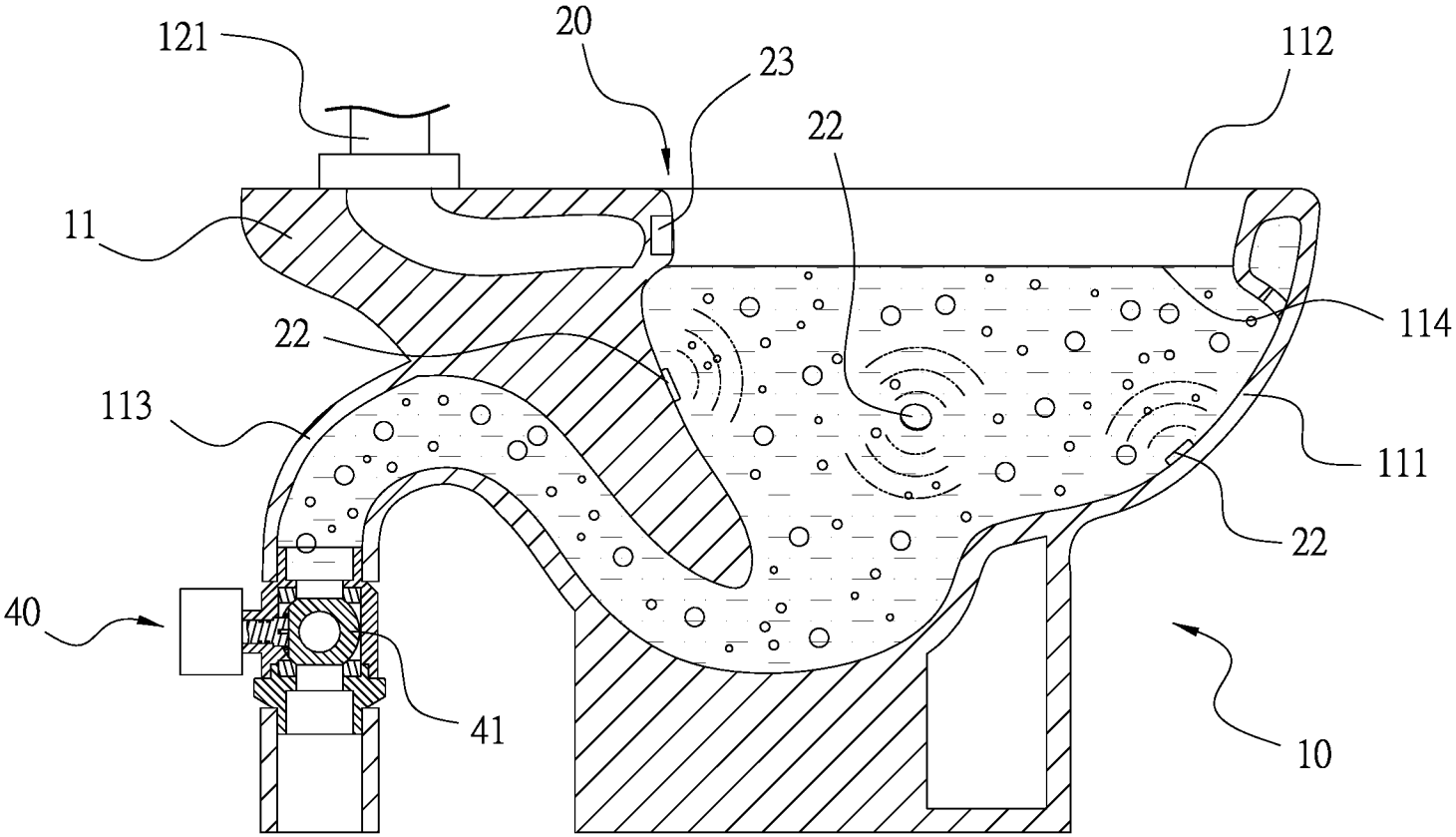
FIG. 5 is a schematic diagram of the oscillation operation of the ultrasonic transducers of the preferred embodiment according to the present invention.

Moreover, as shown in FIG. 3-FIG. 5, a cleaning agent box 129 is fixed in the water tank 12, and the cleaning agent box 129 penetrates into the overflow opening 123 of the overflow pipe 122 with a tubal body 1291. The tubal body 1291 further comprises a valve member 1292 connected to the controller 21, wherein when the valve member 1292 is opened, a siphon effect is generated when water is injected through the bypass pipe 31, causing the cleaning agent box 129 to inject a cleaning agent. The bypass pipe 31 further comprises a bubbler 32 in the overflow pipe 122, the tubal body 1291 is inserted into the bubbler 32, and the bubbler 32 further comprises a mesh body 321, so that the water flow of the bypass pipe 31 and the cleaning agent in the cleaning agent box 128 is mixed in the bubbler 32, and a foaming effect is formed by the mesh body 321.

Figure 6:
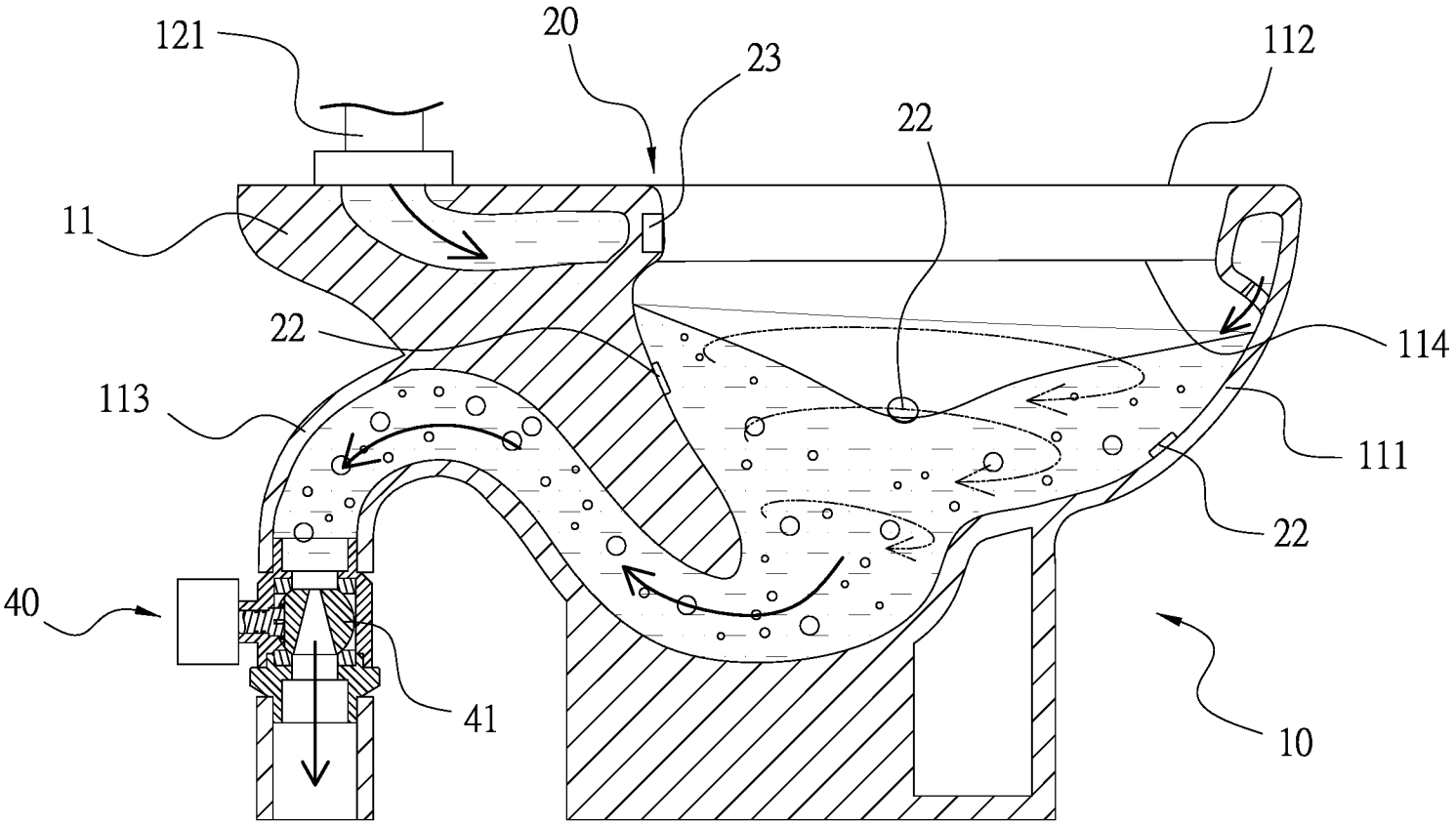
FIG. 6 is a schematic diagram of the vortex cleaning operation of the preferred embodiment according to the present invention.

Please refer to FIG. 5 and FIG. 6. the blocking member 40 further comprises a ball valve in the drain elbow 113, and the blocking member 40 rotates the ball valve 41 to control the flow of the drain elbow 113. At Step D, the controller 21 drives the ball valve 41 of the blocking member 40 to open a quarter of the opening, and maintains continuous water injection of the bypass pipe 31 and continuous operation of the ultrasonic transducers 22. Furthermore, the oscillating cleaning is performed under the vortex circulation flow of the water, thereby cleanliness is effectively improved. Also, the blocking member 40 can be directly rotated by a stepping motor, thereby achieving the effect of accurately controlling the position of the ball valve 41.

Figure 7:
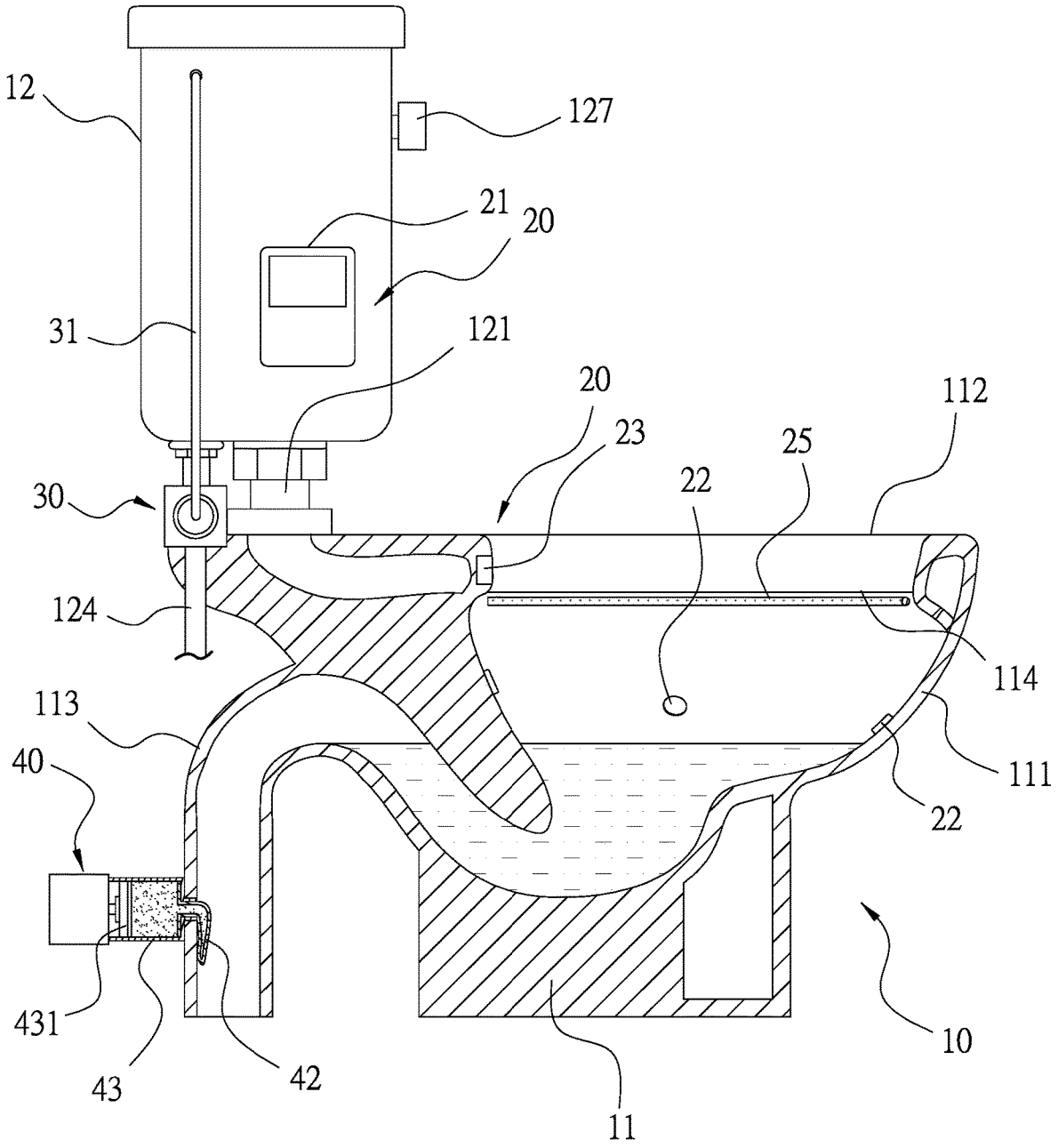
FIG. 7 is a cross-sectional view of another blocking member of the preferred embodiment according to the present invention.

As shown in FIG. 7, the controller 21 is connected to an ultraviolet light strip 25, and the ultraviolet light strip 25 is arranged around and below the flushing ring opening 114 and used to provide an ultraviolet light sterilization cleaning effect to the urinal 111. Also, the ultraviolet light strip 25 is hidden under the seat 112 of the sitting toilet seat 11.

Figure 8:
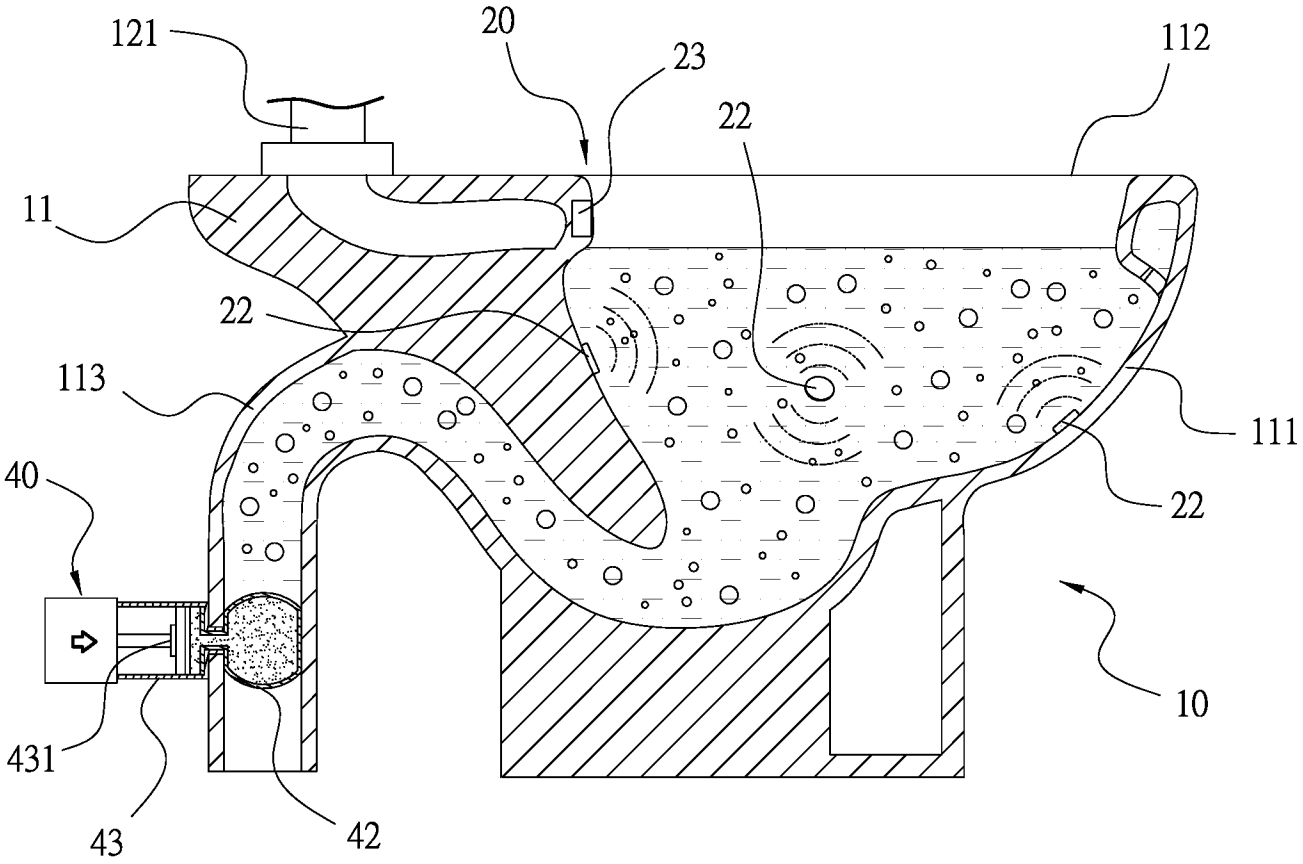
FIG. 8 is a schematic drawing of the operation of another blocking member of the preferred embodiment according to the present invention.
Figure 9:
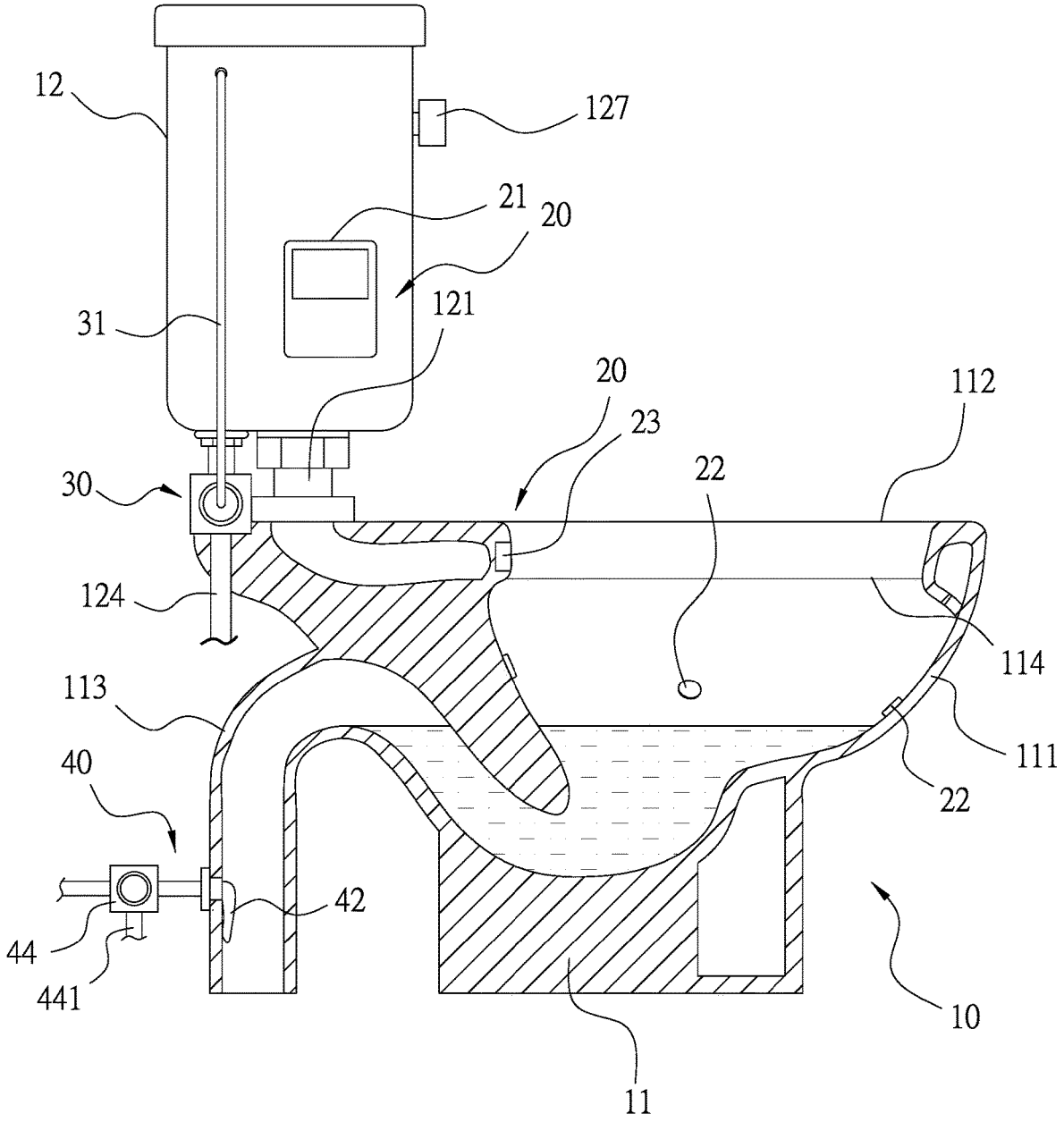
FIG. 9 is a cross-sectional view of another blocking member of the preferred embodiment according to the present invention.

Please refer to FIG. 7 and FIG. 8 again, the blocking member 40 further comprises a rubber ball 42 in the drain elbow 113 and water flow of the drain elbow 113 is controlled by filling water into the rubber ball 42. The blocking member 40 further comprises a cylinder 43 mounted outside the drain elbow 113, and the cylinder 43 comprises a piston 431 driven by the blocking member 40 to fill air in the cylinder 431 into the rubber ball 42, to block the drain elbow 113 and allow the water to fill the urinal 111. Reversely, the piston 431 returns by sucking back the air in the rubber ball 42 so the blocking member 40 does not block the drain elbow 113 to provide an equivalent oscillation cleaning function, and a larger flow rate can be provided when the drain elbow 113 is open. Please refer to FIG. 9, the blocking member 40 is connected to the drain elbow 113 with a water control valve 44, one end of the water control valve 44 connected to a water source, another other end of the water control valve 44 connected to a drain pipe 441, and the water control valve 44 allows the water to flow into the rubber ball 42 and discharge from the drain pipe 441. The rubber ball 42 has a small volume when it is not filled, so the blocking member 40 can be installed and replaced only by opening a tiny hole at the drain elbow 113, so as to save assembly time and reduce construction difficulty.

Although the present invention has been explained in relation to its preferred embodiment, it is to be understood that many other possible modifications and variations can be made without departing from the spirit and scope of invention as hereinafter claimed.

What is claimed is:

1. A self-cleaning toilet comprising:

a toilet having a sitting toilet seat and a water tank, the sitting toilet seat formed with a urinal, and one end of the urinal having an enlarged opening to form a seat, and the urinal tapering from the seat to the other end to form a drain elbow, an inner edge of the toilet adjacent to the seat comprising a flushing ring opening; the water tank mounted above the sitting toilet seat and having an outlet pipe connected to the flushing ring opening of the toilet; the water tank connected to an input pipe, the outlet pipe being bypassed by an overflow pipe, the overflow pipe having an overflow opening at a position that is higher than a full water level of the water tank; and a cleaning agent box fixed inside the water tank, the cleaning agent box penetrating into the overflow opening of the overflow pipe with a tubal body;

a cleaning device comprising a controller and disposed in the toilet, the controller connected to a plurality of ultrasonic transducers and at least one full water level sensor, the ultrasonic transducers mounted on an inner wall of the toilet, the full water level mounted under the seat;

a solenoid valve connected to the input pipe and a bypass pipe, the bypass pipe penetrating into the water tank and disposed at the overflow opening into the overflow pipe, and the solenoid valve electrically connected to the controller; and a blocking member connected to the drain elbow and electrically connected to the controller, the blocking member controlling flow in the drain elbow;

wherein when the blocking member blocks the drain elbow, the solenoid valve is configured to control water flow to flow into the urinal from the bypass pipe, and after the full water level sensor detects a full water level, the water is stopped and the ultrasonic transducers perform cleaning operations.

2. The self-cleaning toilet as claimed in claim 1, wherein the controller is connected to an ultraviolet light strip, and the ultraviolet light strip is arranged around and below the flushing ring opening and used to provide an ultraviolet light sterilization cleaning effect to the urinal.

3. The self-cleaning toilet as claimed in claim 1, wherein the tubal body further comprises a valve member connected to the controller, wherein when the valve member is opened, a siphon effect is generated when water is injected through the bypass pipe, causing the cleaning agent box to inject a cleaning agent.

4. The self-cleaning toilet as claimed in claim 3, wherein the bypass pipe further comprises a bubbler in the overflow pipe, the tubal body inserted into the bubbler, and the bubbler further comprises a mesh body, so that the water flow of the bypass pipe and the cleaning agent in the cleaning agent box is mixed in the bubbler, and a foaming effect is formed by the mesh body.

5. The self-cleaning toilet as claimed in claim 1, wherein the blocking member further comprises a ball valve in the drain elbow, and the blocking member rotates the ball valve to control the flow of the drain elbow.

6. The self-cleaning toilet as claimed in claim 5, wherein the controller drives the ball valve of the blocking member to open a quarter of the opening, and maintains continuous water injection of the bypass pipe and continuous operation of the ultrasonic transducers.

7. The self-cleaning toilet as claimed in claim 1, wherein the blocking member further comprises a rubber ball in the drain elbow and water flow of the drain elbow is controlled by filling water into the rubber ball.

8. The self-cleaning toilet as claimed in claim 7, wherein the blocking member further comprises a cylinder mounted outside the drain elbow, and the cylinder comprises a piston driven by the blocking member to fill air in the cylinder into the rubber ball.

9. The self-cleaning toilet as claimed in claim 7, wherein the blocking member is connected to the drain elbow with a water control valve, one end of the water control valve connected to a water source, another other end of the water control valve connected to a drain pipe, and the water control valve allows the water to flow into the rubber ball and discharge from the drain pipe.

10. The self-cleaning toilet as claimed in claim 1, wherein the input pipe further comprises a water injection rod inserted into the water tank, a floating ball connected to a top end of the water injection rod, the water injection rod further comprises a control handle connected to a water plug for controlling the outlet pipe, and the controller is electrically connected to a sensing element mounted at the control handle for opening the ball valve when the handle is rotated.

* * * * *